US007281453B2

(12) United States Patent
Wu

(10) Patent No.: US 7,281,453 B2
(45) Date of Patent: Oct. 16, 2007

(54) ADJUSTABLE SPANNER CAPABLE OF ADJUSTING SIZE OF AN OPENING RAPIDLY

(75) Inventor: Arthur Wu, Taichung Hsien (TW)

(73) Assignee: Proxene Tools Co., Ltd., She Kou Village, Shen Kang Taichang (TW)

( * ) Notice: Subject to any disclaimer, the term of this patent is extended or adjusted under 35 U.S.C. 154(b) by 0 days.

(21) Appl. No.: 11/333,033

(22) Filed: Jan. 18, 2006

(65) Prior Publication Data

US 2007/0163399 A1 Jul. 19, 2007

(51) Int. Cl.
*B25B 13/20* (2006.01)

(52) U.S. Cl. ..... 81/142; 81/145

(58) Field of Classification Search ..... 81/142, 81/145, 143, 129.5, 133
See application file for complete search history.

(56) References Cited

U.S. PATENT DOCUMENTS 1,061,625 A * 5/1913 Post ..... 81/145
1,523,093 A * 1/1925 Wilcox ..... 81/145
2,724,301 A * 11/1955 Maurice et al. ..... 81/145
2,850,932 A * 9/1958 Bonkowski ..... 81/145
3,376,767 A * 4/1968 O'Quinn ..... 81/145
3,535,959 A * 10/1970 Riza ..... 81/472
3,817,128 A * 6/1974 Evans ..... 81/145
4,106,372 A * 8/1978 Miller ..... 81/143
5,152,198 A * 10/1992 Schmitz, Jr. ..... 81/145
6,983,676 B1 * 1/2006 Huang ..... 81/145
2004/0074345 A1 * 4/2004 Huang ..... 81/142

* cited by examiner

*Primary Examiner*—D. S. Meislin

(57) ABSTRACT

An adjustable spanner capable of adjusting size of an opening rapidly comprises a handle having a head and a fixing jaw; the handle having a sliding groove and a sliding path; an inner sliding path being extended with a shoulder; a movable jaw having a guide portion at one end thereof; a lower side of the guide portion having a teeth portion; a sliding block being installed in the sliding path; the sliding block having a teeth portion near the movable jaw and an elastic unit at a position far away from the movable jaw; and at least one pressible unit having an connecting unit and an operation portion; the connecting portion being connected to the sliding block; and the operation portion being at one side of the handle; an inner side of the pressible unit having buckling unit for resisting against the shoulder of the sliding path.

6 Claims, 8 Drawing Sheets

ADJUSTABLE SPANNER CAPABLE OF ADJUSTING SIZE OF AN OPENING RAPIDLY

FIELD OF THE INVENTION

The present invention relates to adjustable spanners, and particularly to an adjustable spanner capable of adjusting size of an opening rapidly, wherein two sliding blocks are not in contact to a shoulder of the sliding path of the handle so as to retain the steadiness in operation. Thereby the defects of deformation from forging and heat processing and too many parts can be avoided. The size of the opening is adjustable rapidly and steadily.

BACKGROUND OF THE INVENTION

In many prior arts, such as U.S. Pat. Nos. 1,501,212, 1,792,338, 2,582,591, 3,535,959, 3,817,128, 4,106,372, and 5,152,198, the adjustable spanners capable of adjusting size of an opening rapidly are disclosed. However all the structures of the spanners are too completed to be made. The operation is unsteady so as to affect the error of the opening of the spanner. This is because in the forging process, the error cannot be avoided, generally, the error is about 0.3 mm to 0.8 mm. This will induce that the grooves in the head of the handle cannot be controlled precisely so that two pressible units are not symmetrical to the center of the head of the handle. Further the heat process will cause the deformation of the parts of the handle so that when a cover is locked to a shoulder, the two sides will curl to affect the smoothness in the pressing operation.

Although CNC lathe can be used to improve the above mentioned defects from forging and heat processing, the CNC process is too expensive. It is not economic to the manufacturing of the spanner.

SUMMARY OF THE INVENTION

Accordingly, the primary object of the present invention is to provide an adjustable spanner capable of adjusting size of an opening rapidly, wherein two sliding blocks are not in contact to a shoulder of the sliding path of the handle to retain the steadiness in operation. The defects of deformation from forging and heat processing and too many parts can be avoided. Thus the size of the opening can be adjusted rapidly and steadily.

To achieve above objects, the present invention provides an adjustable spanner capable of adjusting size of an opening rapidly. The adjustable spanner comprises a handle having a head and a fixing jaw; the handle has a sliding groove and a sliding path; the sliding path being at hole communicated to the sliding groove and penetrated through the head; an inner sliding path being extended with a shoulder; a movable jaw having a guide portion at one end thereof; a lower side of the guide portion having a teeth portion; the guide portion being received in the sliding groove so that the movable jaw being movable along the sliding groove; a sliding block movable along a direction approach to or away from the movable jaw; the sliding block being installed in the sliding path; the sliding block having a teeth portion at a position near the movable jaw and an elastic unit at a position far away from the movable jaw for engaging the teeth portion of the sliding block and the teeth portion of the movable jaw; and at least one pressible unit having an connecting unit and an operation portion; the connecting portion being connected to the sliding block; and the operation portion being at one side of the handle; an inner side of the pressible unit having buckling unit for resisting against a surface of the shoulder of the sliding path.

The various objects and advantages of the present invention will be more readily understood from the following detailed description when read in conjunction with the appended drawing.

DETAILED DESCRIPTION OF THE INVENTION

Figures 1, 1A:
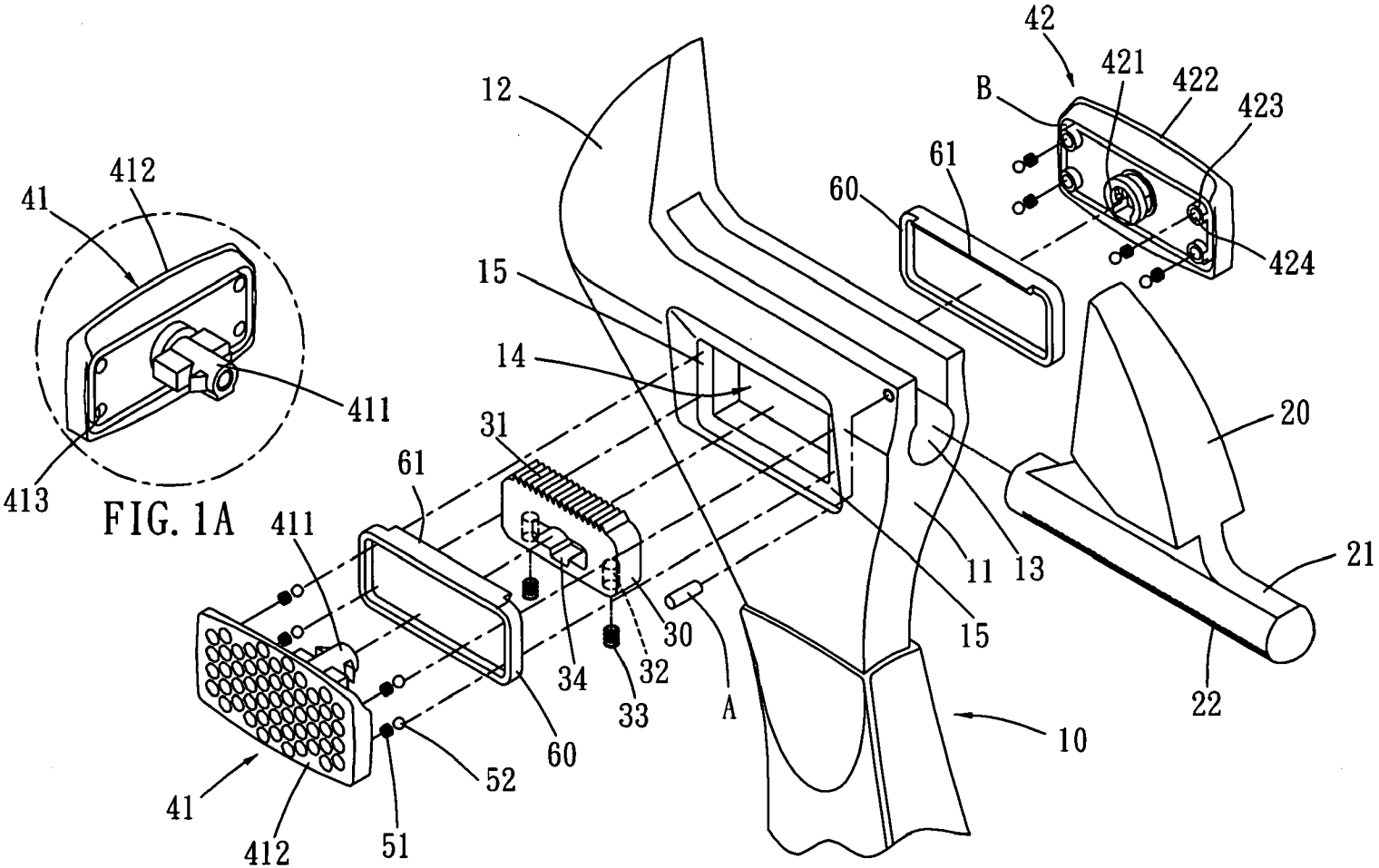
FIG. 1 is an exploded schematic view of the adjustable spanner capable of adjusting size of an opening rapidly according to the present invention.
FIG. 1A is another schematic perspective view of the present invention.
Figure 2:
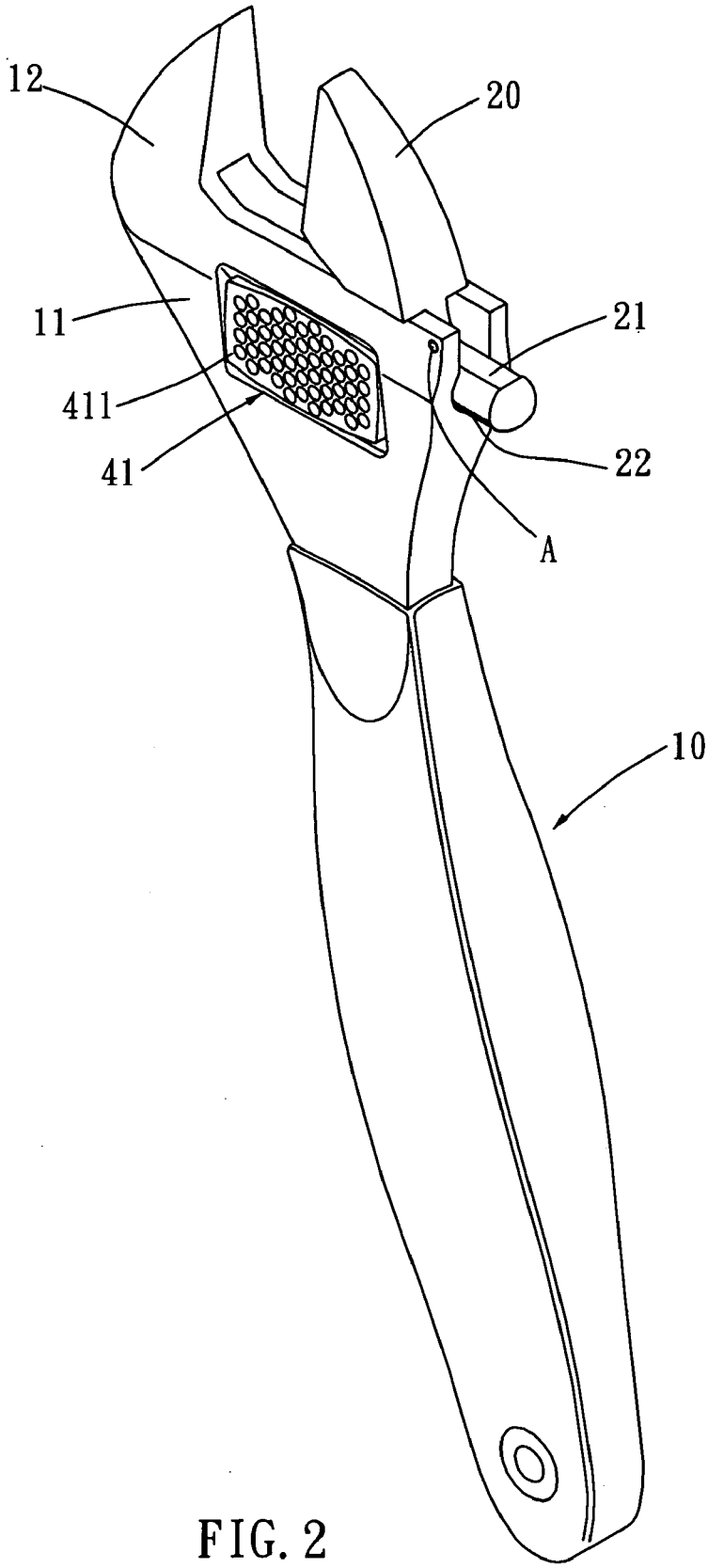
FIG. 2 is a perspective view about the adjustable spanner capable of adjusting size of an opening rapidly of the present invention.
Figure 3:
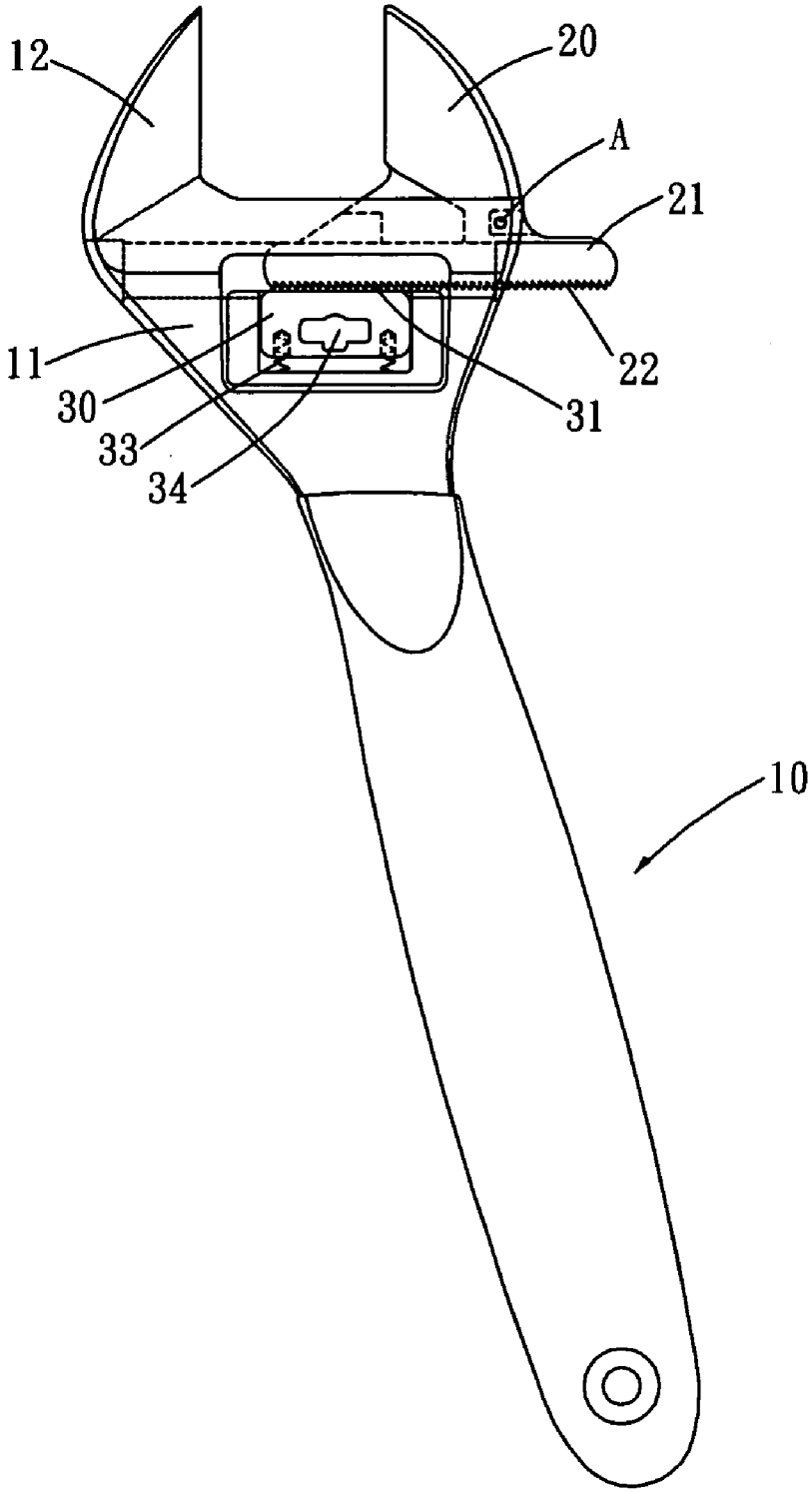
FIG. 3 is a partial perspective view of the adjustable spanner capable of adjusting size of an opening rapidly of the present invention.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Referring to FIG. 1 to 4, the adjustable spanner capable of adjusting size of an opening rapidly of the present invention is illustrated. The present invention has the following elements.

A handle 10 has a head 11 at one end thereof. A fixing jaw 12 extends from the head 11. A sliding groove 13 is longitudinally formed in the head 11. A sliding path 14 is a long penetrating hole which formed transversally in the head 11 and is communicated to the sliding groove 13. However the penetrating hole 14 may be replaced by a hole with seal ends. All these are within the scope of the present invention. An inner side of the sliding path 14 is protruded with a shoulder portion 15 at an inner periphery of the penetrating hole.

A movable jaw 20 has a guide portion 21. A configuration of the guide portion 21 is corresponding to the sliding groove 13. A lower side of the guide portion 21 is formed as a teeth portion 22. The teeth portion 22 of movable jaw 20 is received within the sliding groove 13 so that the movable jaw 20 is movable along the sliding groove 13. A pin A is inserted through one open end of the sliding groove 13 so as to confine the movement of the movable jaw 20 and thus the movable jaw 20 will not fall out of the sliding groove 13.

A sliding block 30 is a long block having a shape corresponding to the that of the sliding path 14. The sliding block 30 is installed in the sliding path 14 of the handle 10 and is movable toward or away from the movable jaw 20. Each of two sides of the lower end of the sliding block 30 has a respective receiving groove 32 for receiving an elastic unit 33. A lower side of the elastic unit 33 resists against a bottom of the sliding path 14 so that a teeth portion 31 of the sliding block 30 is engaged to the teeth portion 22 of the movable jaw 20. Besides, a lower side of the sliding block 30 is formed with a cruciform shape form through hole 34.

A pressible unit is included. In this embodiment, the sliding path 14 is a penetrating hole. Thus the pressible unit is formed by a first movable part 41 and a second movable part 42. The first movable part 41 has a first connecting portion 411 and a first operation block 412. The second movable part 42 has a second connecting portion 421 and a second operation block 422. The first connecting portion 411 can be buckled to the second connecting portion 421 to combine the first movable part 41 and the second movable part 42. In assembly, the first movable part 41 and second movable part 42 are located within the through hole 34 of the sliding block 30. The first operation block 412 and the second operation block 422 are at two lateral sides of the handle so that the user can press the operation blocks. The outer sides of the first and second operation blocks are lower than outer sides of the head 11. The distance between the outer sides of the first and second operation blocks are smaller than a thickness of the head 11 so that the operation blocks will not contact with a surface as the adjustable spanner is placed upon the surface.

The main feature of the present invention is that each of four corners of the first movable part 41 has a receiving groove 413. Each receiving groove 413 is installed with a spring 51 and a steel ball 52. Each of the four corners of the second movable part 42 has a hollow post 423. A hollow portion of each hollow post has a spring 51 and a steel ball 52. When the first connecting portion 411 is engaged to the second connecting portion 421, all the steel balls 52 resist against outer surfaces of the shoulder 15. Thereby the first movable part 41 and second movable part 42 are not in contact with the shoulder surface 15.

Figure 4:
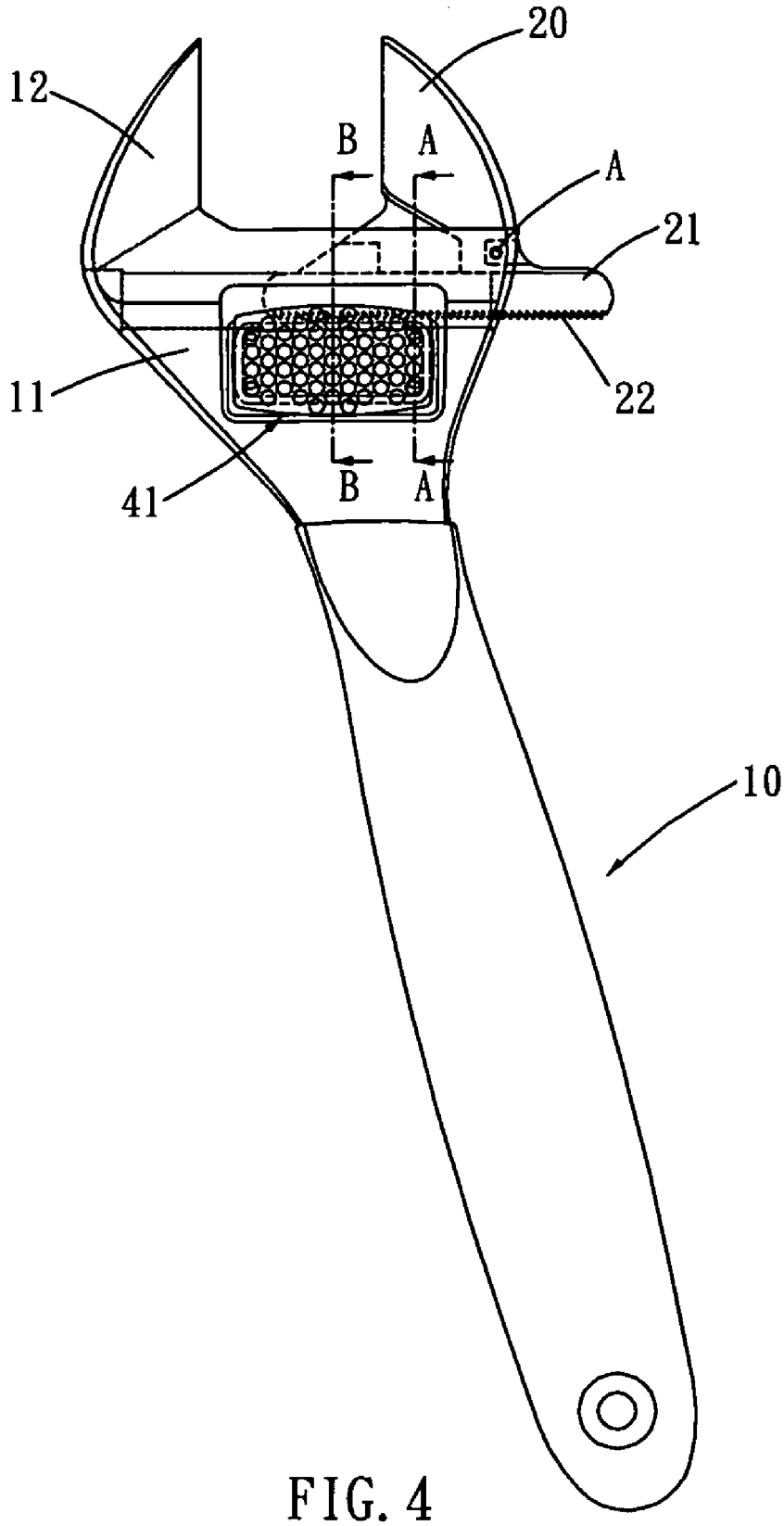
FIG. 4 is a plane view of the spanner in FIG. 2.
Figure 4A:
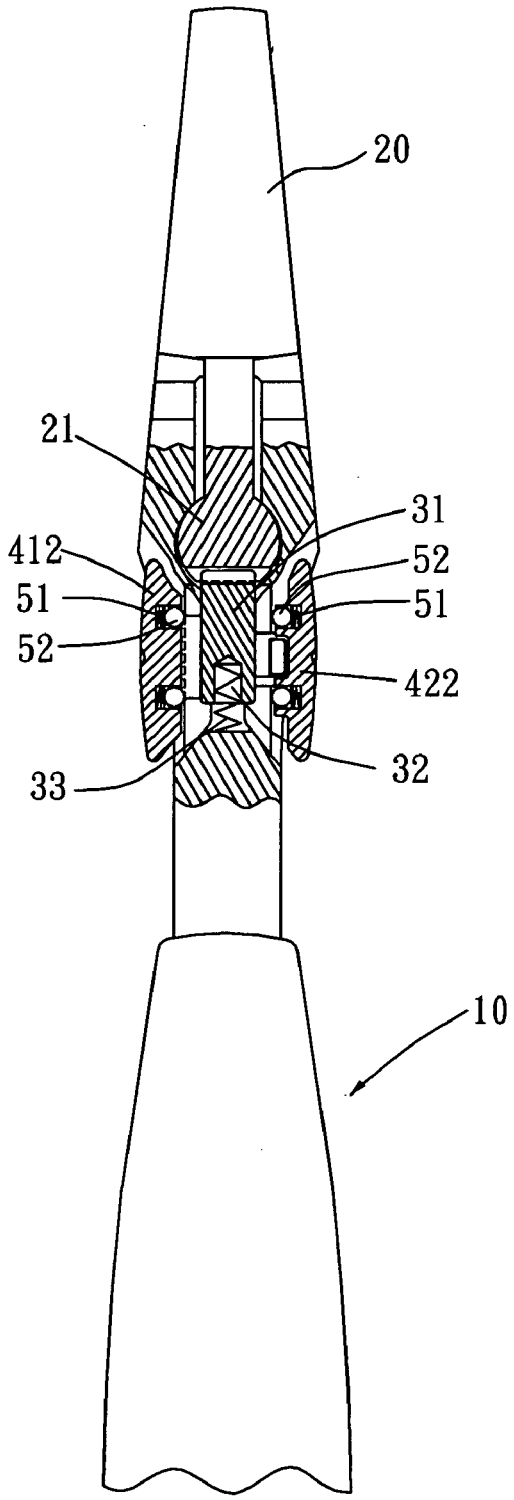
FIGS. 4A and 4B show the resisting operation of the present invention.
Figure 4B:
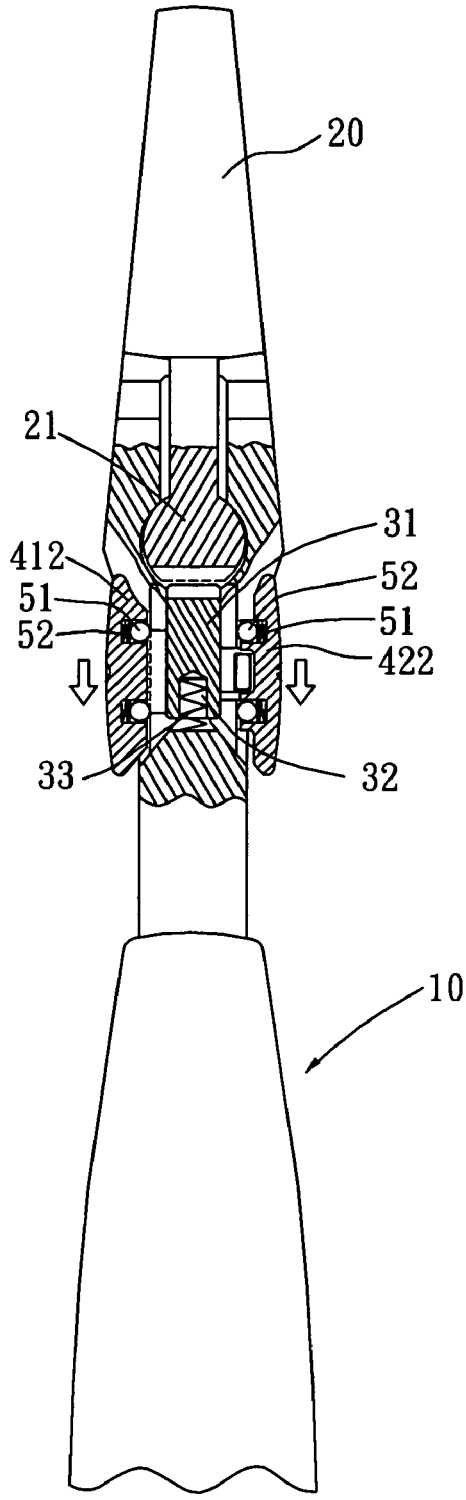
Figure 4C:
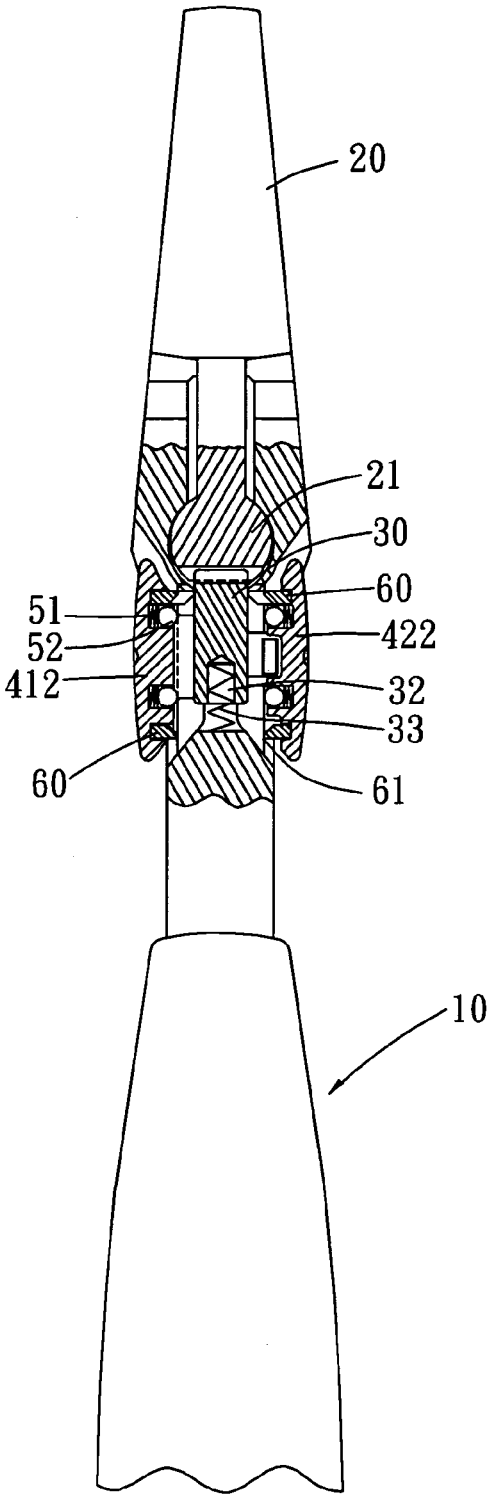
FIGS. 4C and 4D show the resisting operation of the buckling unit and the elastic seal of the present invention.
Figure 4D:
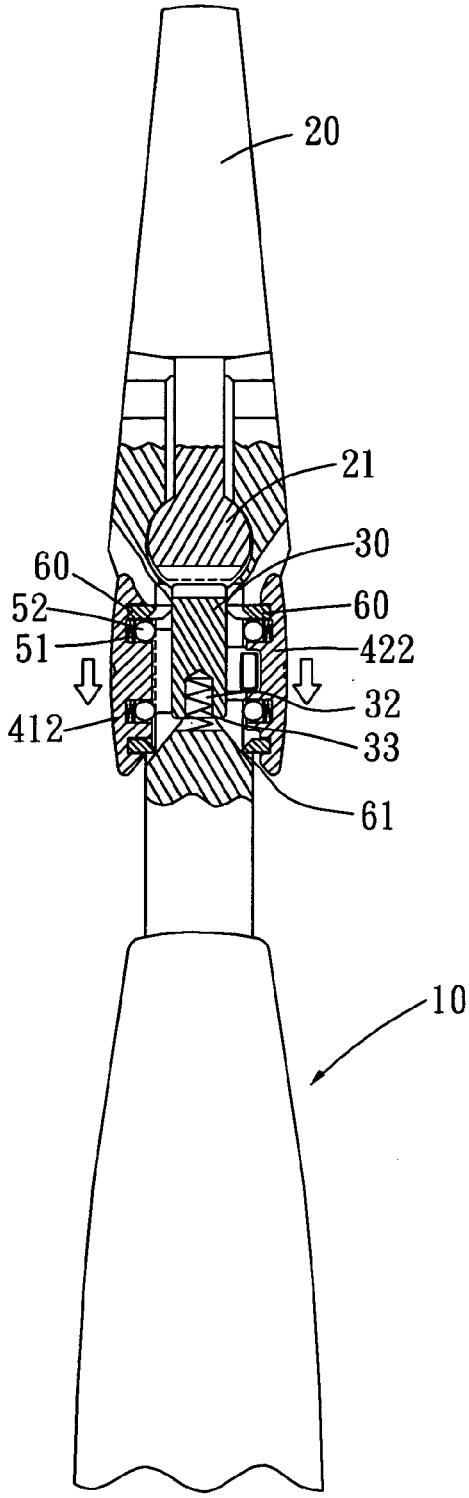

Besides, an inner periphery of the first movable part 41 has a groove B for receiving an elastic seal 60. An inner periphery of the second movable part 42 has a groove B for receiving another elastic seal 60 so that the seals 60 resist against the outer surfaces of the shoulder 15. After assembly, the first movable part 41 and second movable part 42 will not in contact with the outer surfaces of the shoulder 15, as shown in FIGS. 4C and 4D.

Referring to FIGS. 4A, 4B, 4C, and 4D, in the present invention, by the spring, steel ball or the elastic seal, the first movable part 41 and second movable part 42 are not in contact with the outer surfaces of the shoulder 15. Thereby the pressible unit can be steadily pressed. The cost in the installation of the present invention is cheap. No CNC lathe is performed. The defects from error of the shoulder 15 and deformation of heat processing are avoided.

Figure 5:
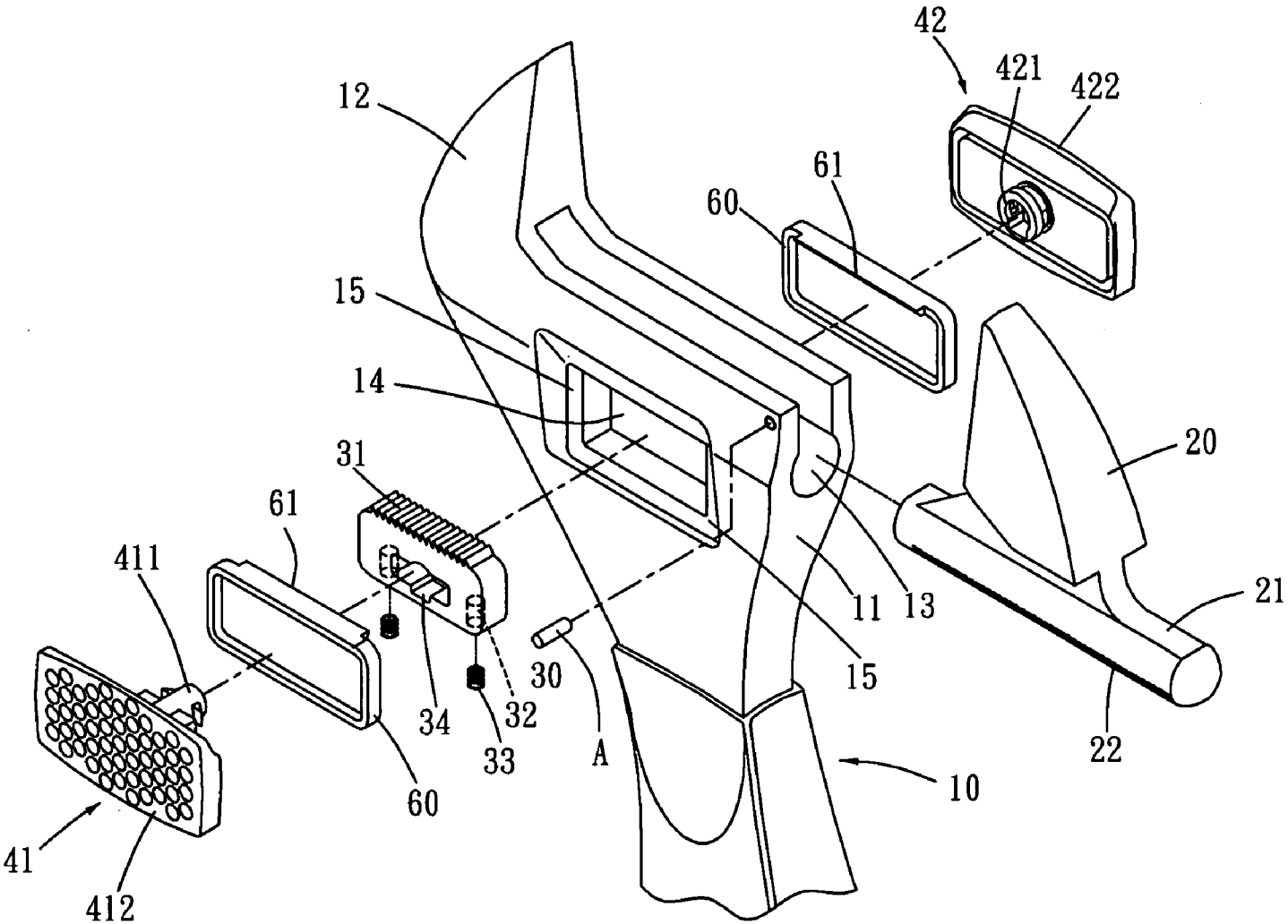
FIG. 5 shows the exploded perspective view of the second embodiment of the adjustable spanner of the present invention.
Figure 5A:
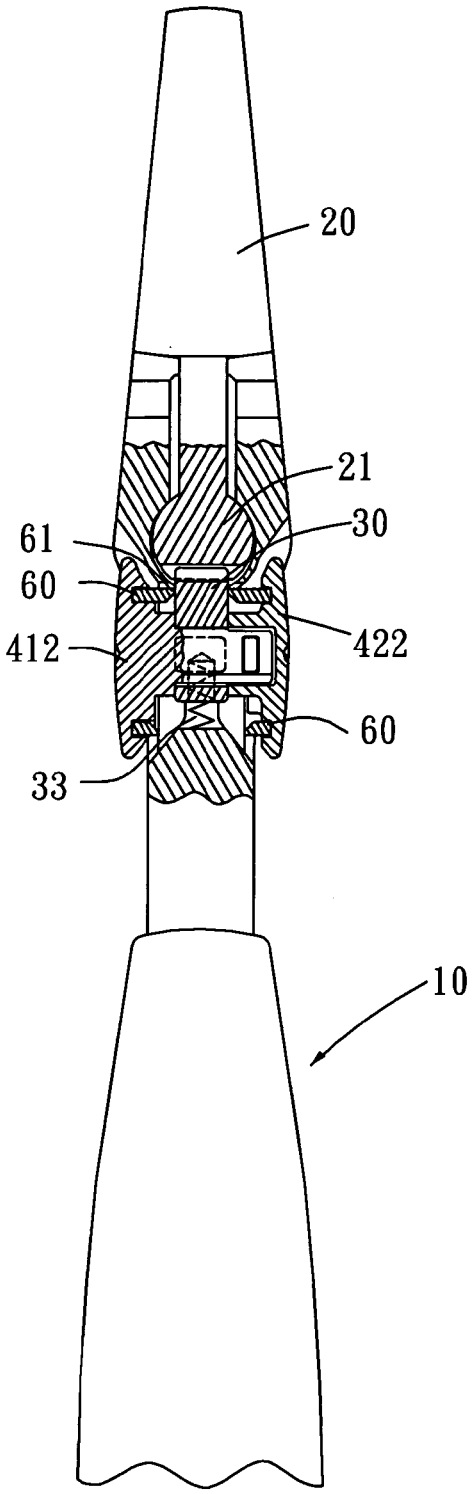
FIGS. 5A and 5B shows the operation of the cross sectional view of the second embodiment of the present invention.
Figure 5B:
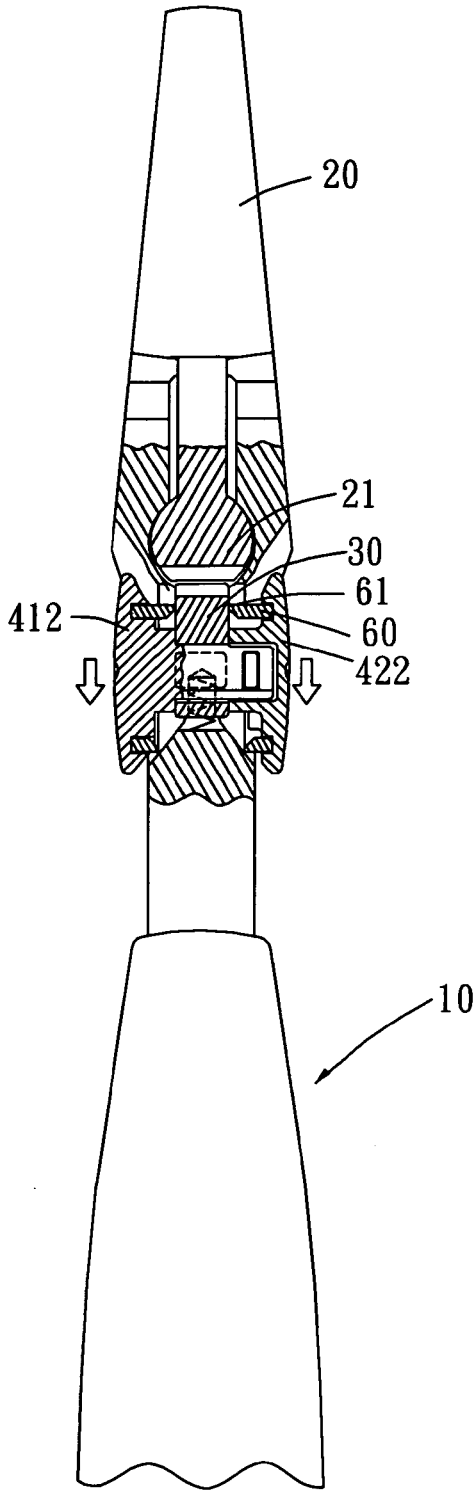

Referring to FIGS. 5, 5A and 5B, in the present invention, in this embodiment, only elastic seal 60 is used. The seals 60 are embedded into the grooves B at an inner peripheries of the first movable part 41 and second movable part 42 so as to have the same effect. Moreover, the elastic seals 60 of the present invention have the effect of dust-proof so that the dust powders will not fall into the sliding path 14. An inner side and two lateral sides of the elastic seal resist against the outer surface of the shoulder and a stop extended from a top of the elastic seal resists against the sliding block 30.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An adjustable spanner capable of adjusting size of an opening rapidly comprising:

a handle having a head and a fixing jaw; the handle having a sliding groove and a sliding path; the sliding path being at a hole communicated to the sliding groove and penetrated through the head; an inner sliding path being extended with a shoulder;

a movable jaw having a guide portion at one end thereof; a lower side of the guide portion having a teeth portion; the guide portion being received in the sliding groove so that the movable jaw being movable along the sliding groove;

a sliding block movable along a direction approach to or away from the movable jaw; the sliding block being installed in the sliding path; the sliding block having a teeth portion at a position near the movable jaw and an elastic unit at a position far away from the movable jaw for engaging the teeth portion of the sliding block and the teeth portion of the movable jaw; and at least one pressible unit having a connecting unit and an operation portion; the connecting portion being connected to the sliding block; and the operation portion being at one side of the handle; an inner side of the pressible unit having a buckling unit for resisting against a surface of the shoulder of the sliding path; and wherein the buckling unit is a spring and a steel ball.

2. The adjustable spanner capable of adjusting size of an opening rapidly as claimed in claim 1, wherein the pressible unit has a first movable part and a second movable part; each first movable part having a connecting portion; the connecting portions of the first movable part and second movable part are located at two sides of the sliding path.

3. The adjustable spanner capable of adjusting size of an opening rapidly as claimed in claim 1, wherein an outer side of the pressible unit is lower than an outer side of the head.

4. The adjustable spanner capable of adjusting size of an opening rapidly as claimed in claim 2, wherein an outer side of the pressible unit is lower than an outer side of the head.

5. The adjustable spanner capable of adjusting size of an opening rapidly as claimed in claim 1, wherein a pin is inserted through one open end of the sliding groove so as to confine the movement of the movable jaw and thus the movable jaw will not fall out of the sliding groove.

6. The adjustable spanner capable of adjusting size of an opening rapidly as claimed in claim 1, wherein an inner side and two lateral sides of the elastic seal resist against the outer surface of the shoulder and a stop extended from a top of the elastic seal resists against the sliding block.

* * * * *